United States Patent [19]

Wojcinski

[11] Patent Number: 4,683,688

[45] Date of Patent: Aug. 4, 1987

[54] CONTAINERIZED SHOOTING RANGE

[76] Inventor: Allan S. Wojcinski, Bonifatiustrasse 88, D-4000 Düsseldorf 11, Fed. Rep. of Germany

[21] Appl. No.: 712,802

[22] Filed: Mar. 18, 1985

[30] Foreign Application Priority Data

Mar. 16, 1984 [DE] Fed. Rep. of Germany ..... 3409768

[51] Int. Cl.[4] ..... E04C 2/32; E04H 14/00; F41J 1/18

[52] U.S. Cl. ..... 52/79.1; 52/801; 273/404; 273/410

[58] Field of Search ..... 273/404, 410; 52/795, 52/799, 801, 79.1; 264/256, 112

[56] References Cited

U.S. PATENT DOCUMENTS

| | | | |
|---|---|---|---|
| 2,616,283 | 11/1952 | Branstrator et al. | 52/795 |
| 2,670,959 | 3/1954 | Broyles | 273/410 |
| 2,812,660 | 11/1957 | Marden et al. | 273/410 |
| 3,290,845 | 12/1966 | Snyder | 52/795 |
| 3,368,473 | 2/1968 | Yoshitoshi et al. | 52/799 |
| 3,447,806 | 6/1969 | Pfaff et al. | 273/410 |
| 3,486,284 | 12/1969 | Steinberger | 52/795 |
| 3,555,756 | 1/1971 | Curran et al. | 52/795 |
| 3,583,123 | 6/1971 | Holmgren | 52/795 |
| 3,715,846 | 2/1973 | Sullhofer | 52/795 |
| 3,733,232 | 5/1973 | Payne | 52/795 |
| 4,164,901 | 8/1979 | Everett | 273/410 |
| 4,201,385 | 5/1980 | Szabados | 273/410 |
| 4,434,592 | 3/1984 | Renault et al. | 52/795 |
| 4,509,301 | 4/1985 | Head | 273/404 |

FOREIGN PATENT DOCUMENTS

| | | | |
|---|---|---|---|
| 771057 | 11/1967 | Canada | 273/410 |
| 602357 | 3/1926 | France | 273/410 |

*Primary Examiner*—William F. Pate, III
*Assistant Examiner*—Michael Safavi
*Attorney, Agent, or Firm*—Peter K. Kontler

[57] ABSTRACT

A firing range assembly includes a transportable container which encloses a firing range. The assembly further includes a ventilating system for ventilating the firing range. Each wall of the container is provided with a lining which functions to: (i) resist penetration by projectiles; and (ii) inhibit rebounding of projectiles.

23 Claims, 8 Drawing Figures

CONTAINERIZED SHOOTING RANGE

BACKGROUND OF THE INVENTION

The invention relates to a shooting range.

It has been known to provide shooting ranges which are installed inside enclosed building structures or the like. A disadvantage of such shooting ranges is that they are stationary. Also, the cost of operating such ranges is high because of the necessary rental of premises.

OBJECTS AND SUMMARY OF THE INVENTION

It is the object of the present invention to provide a shooting range which is movable or transportable so as to enable it to be operated at different locations as desired.

This object is achieved by a shooting range which is characterized by being confined in a transportable container having ventilating means, and walls designed to resist penetration by projectiles and to inhibit rebounding of projectiles therefrom.

The essential advantage of the inventive shooting range is that it may be operated in a very simple manner in a variety of locations. To this end, it is necessary only to transport the container housing or forming the shooting range to the desired location and to re-install or to re-assemble it at that new location.

Another essential advantage of the present invention is that operating it will not cause or give rise to any relatively high permanent rental expenses.

Advantageously, the inventive shooting range includes noiseabating means so as to satisfy statutory noise emission specifications.

Also, and advantageously, the inventive shooting range is ventilated across its entire cross section in a manner such as to immediately remove any powder vapors or fumes that develop during range operation.

Another advantage of the inventive shooting range is that the walls defining it do not consist of combustible material. Advantageously, these walls are lined so as to attenuate firing noise and the like inside the container.

BRIEF DESCRIPTION OF THE DRAWINGS

The invention and embodiments thereof will now be explained in detail with reference to the attached drawings, wherein

FIG. 1 shows the interior of an inventive shooting range from the top. Container 1 forming the shooting range comprises side walls 2, 3, a rear wall 4 and a front wall 5; its bottom wall 6 and top wall 7 are shown in FIG. 2. Walls 2, 3, 4, 5, 6 and 7 have thereon noise attenuating liners 2', 3', 4', 5', 6' and 7' which also are penetration- and rebound-proof. The structure of these liners will be explained in detail below. The firing direction is shown by arrow 15. In front of rear wall 4 is placed a firing or target surface structure 19 comprising a steel frame mounting under slight tension a back layer of rubber strips and a front layer of rubber tapes in foil form. The foil preferably carries a nondrying synthetic material which is plastic in nature and visually displays the hit pattern after a number of shots has been fired because the rubber foil will displace the plastic material in the area of the impact hole. After a series of shots has been fired, the paste may be smoothed readily by means of a roller. The transverse frame of structure 19 may be swung out of the way like a door towards a side wall 3 of container 1 to be secured thereto; such swinging movement requires very little force. To this end, a hinge 42 is provided on the side of the frame of structure 19 which extends adjacent side wall 3. The opposite side of the frame of structure 19 preferably is provided with roller means 43 to roll across bottom 6 of container 1.

Figure 1:
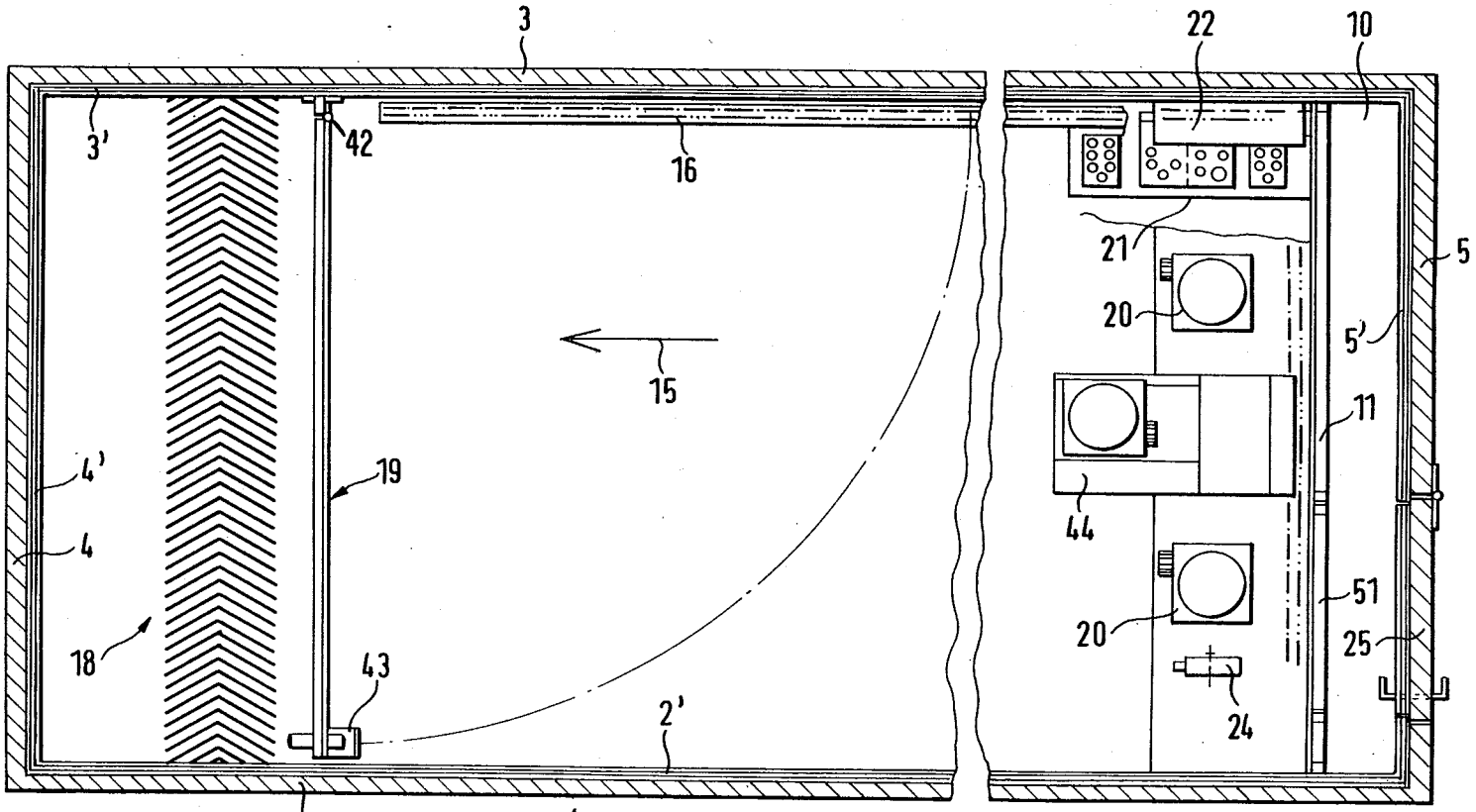
FIGS. 1 and 2 show an embodiment of the invention.
Figure 2:
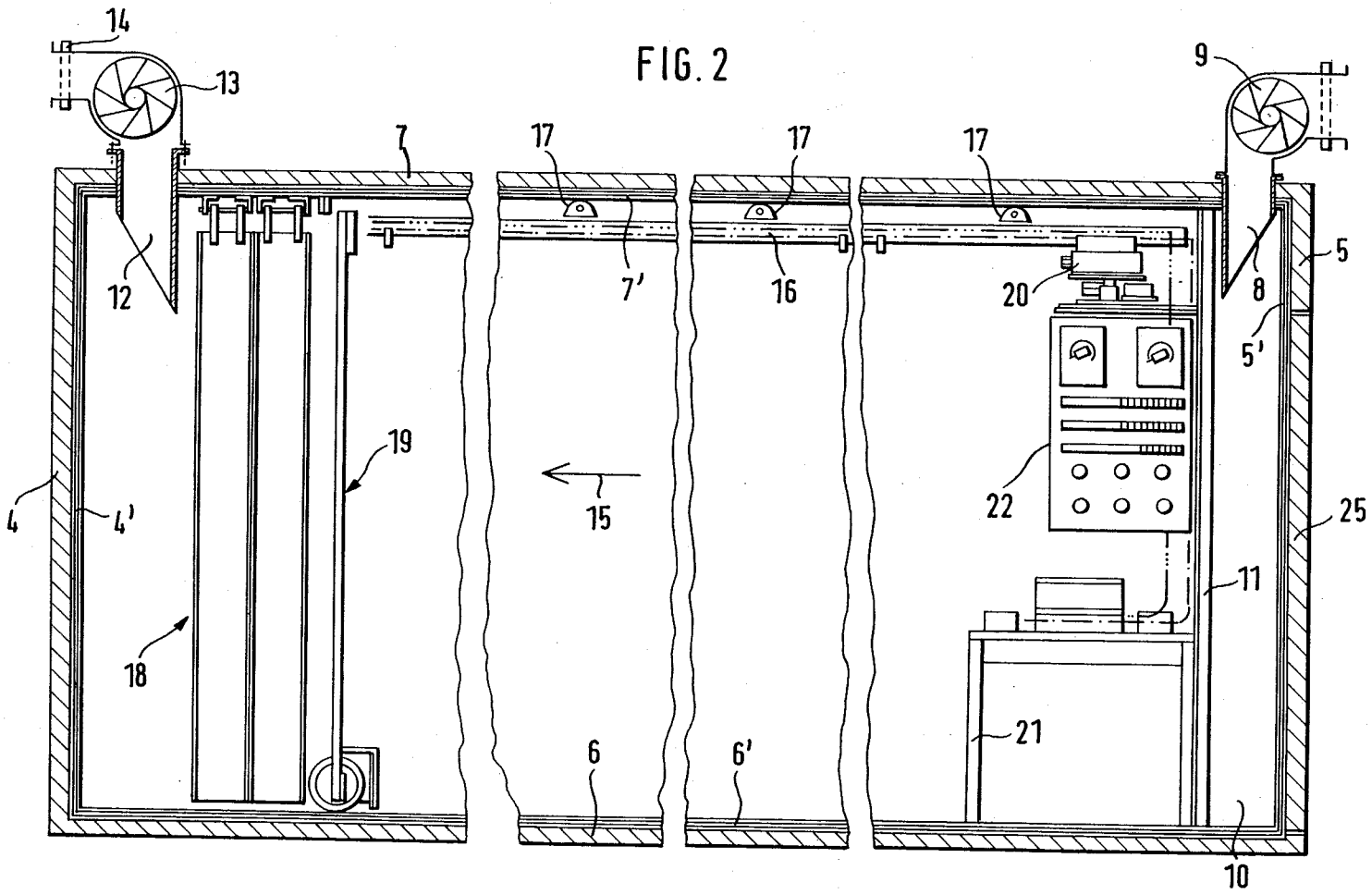

Between the transverse structure 19 and rear wall 4, there is placed a backstop 18 consisting preferably of two rows of louvered panels of hard rubber material.

There are provided on the side opposite rear wall 4 projectors 20 which enable stationary target patterns to be projected onto surface 19. A simulator 44 is provided to display moving targets on surface 19. Simulator 44 and projectors 20 may be controlled from a control panel 21.

For firing towards a target surface 19 located at a distance of more than 15 meters from the marksman, a video camera 24 and a monitor (not shown) are provided to visually display the impact pattern.

Also provided on the side opposite rear wall 4 and along a side wall 3 is a power control box 22 for controlling the ventilating means, the lighting and the supply of power to all the equipment used in the range.

Lighting fixtures 17 are provided on the top wall 7 to sufficiently illuminate all of the interior of container 1. Fixtures 17 are protected individually against projectile impact by means of blinds. Power is supplied to the lighting fixtures through a power cable run through penetration- and rebound-proof cable channel 16 secured to one of side walls 2, 3 or to top wall 7.

There will now be explained with reference to FIGS. 3 and 4 the construction of the container walls and of the liners secured thereto.

Preferably—or conventionally—, the container walls consist of corrugated metal panels corrugated in a trapezoidal or right-angular pattern. Walls of this type usually do not provide the required degree of noise abatement. Also, they are easily pierced by projectiles. For this reason, the recesses formed by these walls are filled on both sides of the panels with a material which contributes to noise attenuation and enhances the piercing or penetration resistance of the panels. Preferably, the recesses in the container walls are filled with concrete or a sand-binder mix. The sand-binder mix preferably consists of 90% sand and 10% polyurethane. In FIGS. 3 and 4, the materials filling the recesses on both sides of the container walls are shown at 45 and 46, respectively. The inner surfaces of container walls 2, 3, 4, 5, 6 and 7 are provided with liners 2', 3', 4', 5', 6' and 7' which comprise a sequence of layers of rubber and steel.

Figure 3:
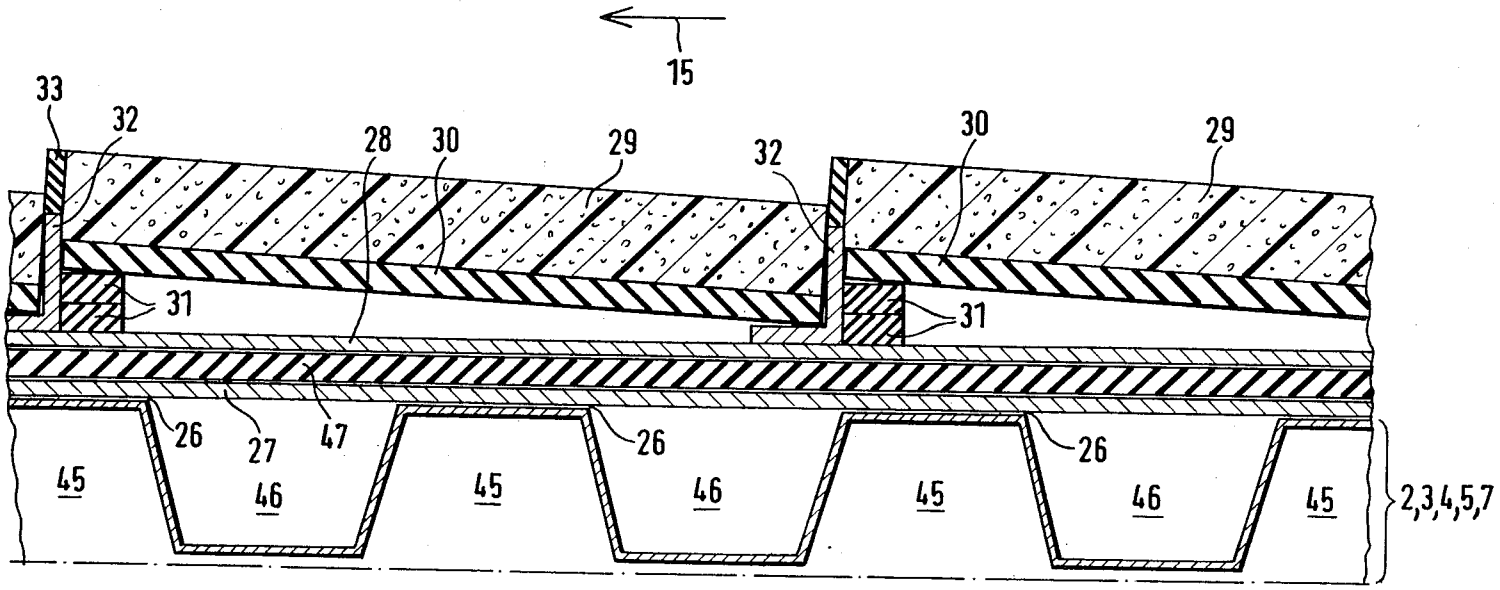
FIGS. 3 and 4 show various wall lining constructions.

In the embodiment of FIG. 3, steel plates 27 are secured to the inner surfaces of container walls 2 to 7. Preferably, these steel plates 27 are bonded to the inner surfaces of container walls 2 to 7 by means of a two-component adhesive and noise attenuating compound 26. Rubber plates 47 are secured to the inner surfaces of steel plates 27. Preferably, these rubber plates too are bonded to the inner surfaces of steel plates 27 by means of a two-component adhesive and noise attenuating compound. Additional steel plates 28 are bonded in a corresponding manner to the inner surfaces of rubber plates 47. Additional rubber and steel plates may follow, it being important that the innermost layer of the lining structure be rubber. The sequence of steel and rubber layers so applied to container walls 2 to 7 is penetration- and rebound-proof and prevents the transmission of noise to the exterior. For noise attenuation, additional noise abating materials—preferably foam layers 29—are provided on the inner surfaces of the innermost steel plates 28. Stated more precisely: These foam layers are secured to side walls 2, 3, front wall 5, rear wall 4 and top wall 7. In the embodiment shown in FIG. 3, foam layers 29 are disposed so that their inner surfaces extend at an angle to firing direction 15 so as to reduce the likelihood of projectiles moving over extended distances in parallel with and across the surfaces of the foam layers 29 and of so damaging these surfaces along major portions thereof. In order to obtain a disposition of foam layers 29 which is angular with respect to firing direction 15, the foam layers preferably are mounted on angularly disposed rubber plates 30, with rubber plate 30 being angularly disposed by virtue of resting along one side on members 31, preferably also of rubber and secured to the surfaces of the innermost rubber plates 28. Along the other side, rubber plates 30 rest inside the corners defined by the legs of angle section members 32, preferably of steel and secured or bonded to the surfaces of the innermost rubber plates 28. Members 31 are secured to—and preferably bonded to—the side of an angle section member 32 opposite a rubber plate 30. An inclined position of rubber plates 30 and foam layers 29 is obtained by the width of a supporting member 31 in a direction perpendicular to the surface of a rubber plate 28 being greater than the corresponding thickness of the leg of angle section member 32 secured to the inside of the rubber plate 28. Owing to the inclined disposition of rubber plates 30 and foam layers 29, a portion of the elevated face of foam layer 29 projects above the adjacent face of the neighboring foam layer 29, which lies at a lower level. This projecting portion is provided with a facing strip 33, preferably of rubber, bonded to the nieghboring foam layers 29 and, if present, to the leg of the corresponding angle section member 32 which is perpendicular to the surfaces of inner rubber plates 28. All the bonding is preferably effected by means of a two-component adhesive admixed with a noise attenuating agent. The inner surface of bottom wall 6, which does not have members 29 to 33 thereon, is preferably provided with tread-resistant antislip rubber flooring.

Figure 4:
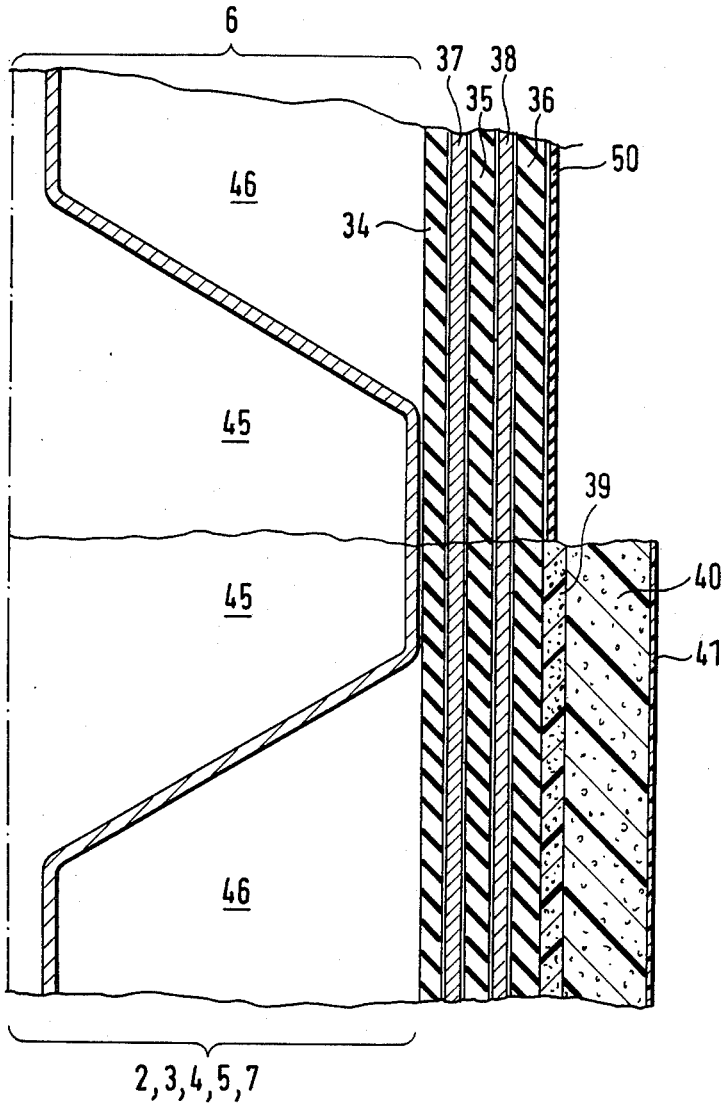

FIG. 4 shows another exemplary embodiment of the lining provided on the inner surfaces of container walls 2 to 7. In this embodiment of the lining structure, rubber plates 34, steel plates 37, rubber plates 35, steel plates 38 and rubber plates 36 are secured in this alternating order on the inner wall surfaces of container walls 2 to 7. Preferably, these plates are secured to each other and to the inner surfaces of container walls 2 to 7 by means of a two-component adhesive and using a noise attenuating agent. Tread-resistant antislip flooring 50 is preferably provided on the inner rubber plates 36 on bottom wall 6. In order to obtain excellent noise abatement characteristics in the interior of the container, noise attenuating layers—particularly foam layers 39 and 40—are provided on the inner surfaces of innermost rubber plates 36 on side walls 2, 3 front wall 5, and rear wall 4. Preferably, foam layer 39 comprises a so-called Bary mat. The foam material layer 40 thereon preferably is a so-called Baryfol layer, and the Baryfol layer preferably has a polyurethane film liner 41 bonded to the inner surface thereof. Foam layers 39 and 40 and, if present, polyurethane film 41 are connected to each other and to inner rubber plates 36 preferably by using a two-component adhesive and a noise attenuating agent admixed therewith.

The supply of fresh air to and the removal of spent air from container 1 are effected by ventilation means substantially comprising an intake fan 9, air conduit means 10, a ventilating panel 11 and an exhaust fan 13 which may be provided with an air filter 14 at the output thereof. Air intake fan 9 propels the air required for ventilation into air conduit means 10 preferably formed by providing a ventilating panel 11 spaced from and extending in parallel with lining 5' and front wall 5, the air conduit means being defined by ventilating panel 11, liner 5' on the front wall and portions of liners 6', 7' on side walls 6 and 7, respectively. The ventilating panel, which preferably extends in parallel with front wall 5, consists of a plate having therethrough openings (not shown) distributed uniformly across the surface thereof. All of these openings in ventilating panel 11 co-operate to uniformly discharge into the interior of container 1 the air which intake fan 9 supplies to air conduit means 10, building up in the interior an air flow which is approximately linear and extends in the direction of arrow 15 from front wall 5 to rear wall 4. This way, fresh air is supplied constantly to the marksmen who may be present in the area of the front wall and of the controls. In the area of rear wall 4 there is provided an exhaust fan 13 to support the removal from the interior of the container of all of the spent air and, particularly, of the powder vapors and fumes which develop while firing is in progress. Preferably, intake fan 9 and exhaust fan 13 are provided inside the container 1 so as to keep noise emission to the environment to a level as low as possible.

Access to the interior of container 1 is provided by a door 25 which serves as a noise lock and is constructed using noise attenuating materials. Preferably, door 25 is disposed in front wall 5. A corresponding door is provided in ventilating panel 11 and is substantially coextensive with access door 25. The door in ventilating panel 11, which in FIG. 1 is shown at 51, consists of the same material as ventilating panel 11.

Preferably, ventilating panel 11 and, if present, the door therein consist of fiberboard, with the openings described above having a total cross-sectional area amounting to about 20% of the surface area of ventilating panel 11.

Figure 5:
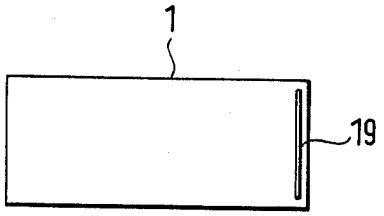
FIGS. 5 and 8 show various containerized shooting ranges embodying the principles of the invention.
Figure 6:
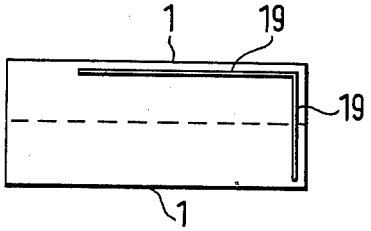
Figure 7:
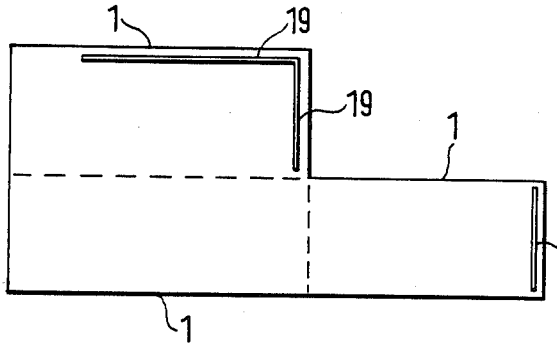
Figure 8:
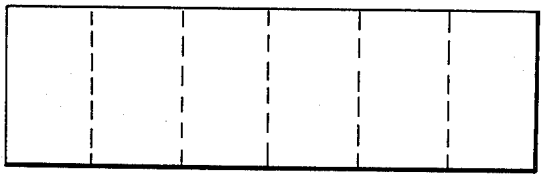

FIG. 5 shows an inventive containerized shooting range in which container 1, which has target surface 19 placed in front of the rear wall, is provided in the form described above. FIG. 6 shows an embodiment in which two target surface assemblies 19 are disposed angularly to obtain a target angle of about 90°. In that case, the range preferably is formed of two individual containers 1 assembled along the broken line, with the corresponding wall elements removed prior to assembly. FIG. 7 shows a shooting range composed of three containers 1, with two target surface assemblies disposed in accordance with FIG. 6 and another target surface assembly 19' being provided for firing from a very long distance, such as the length of two containers 1. FIG. 8 shows how to assemble a plurality of containers 1 for forming long shooting ranges, with the corresponding walls being removed along the broken lines. In general, any number of containers 1 may be assembled as required by a particular shooting range operation. Advantageously, the inventive shooting range may be altered and re-assembled as desired.

Preferably, plates 27 and 37 are of armoring steel.

I claim:

1. A shooting range assembly, comprising a transportable container having a pair of side walls, a front wall, a rear wall, a bottom wall and a top wall, said walls cooperating to define a shooting range internally of said container and including a door for gaining access to said shooting range, each of said walls being designed to resist penetration by projectiles and to inhibit rebounding of projectiles therefrom, and at least one of said walls comprising a pair of rubber layers, and a steel layer sandwiched between said rubber layers and bonded to at least one of the latter; target means carried by said container; and ventilating means for ventilating said shooting range mounted on said container.

2. The assembly of claim 1, wherein at least one of said walls comprises a panel having corrugations, and a material designed to attenuate noise and to resist penetration by projectiles in said corrugations.

3. The assembly of claim 2, wherein said material comprises a mixture of sand and a binder.

4. The assembly of claim 3, wherein said material comprises about 90 percent sand and about 10 percent polyurethane.

5. The assembly of claim 1, wherein said ventilating means comprises an air intake fan for drawing air into said shooting range, and an exhaust fan for removing air from said shooting range.

6. The assembly of claim 5, wherein said ventilating means comprises a panel substantially paralleling one of said walls and cooperating with said one wall to define a conduit for conducting air away from said intake fan, said panel having openings therethrough.

7. The assembly of claim 6, said one wall being said front wall; and wherein said target means comprises a target surface located in the region of said rear wall.

8. The assembly of claim 6, wherein said openings are substantially uniformly distributed over said panel.

9. The assembly of claim 6, wherein the total cross-sectional area of said openings is equal to about 20 percent of the area of said panel.

10. The assembly of claim 1, wherein said one wall comprises a pair of steel layers, one of said rubber layers being sandwiched between said steel layers.

11. The assembly of claim 1, wherein said one wall comprises an additional steel layer arranged so that one of said rubber layers is sandwiched between said steel layers, and an additional rubber layer arranged so that said additional steel layer is sandwiched between said one rubber layer and said additional rubber layer.

12. The assembly of claim 1, wherein each of said walls comprises a respective steel plate, and a respective rubber plate bonded to the corresponding steel plate.

13. The assembly of claim 1, wherein said one wall further comprises a noise attenuating layer.

14. The assembly of claim 13, wherein said noise attenuating layer substantially parallels said steel and rubber layers.

15. The assembly of claim 13, wherein each of said side, front, rear and top walls comprises a respective steel plate, a respective rubber plate bonded to the corresponding steel plate, and a respective noise attenuating plate, the plates of each of said side, front, rear and top walls being substantially parallel to one another.

16. The assembly of claim 13, wherein said noise attenuating layer comprises a foamed material.

17. The assembly of claim 16, wherein said one wall comprises an additional layer of foamed material on said noise attenuating layer.

18. The assembly of claim 17, wherein said additional layer comprises a Baryfol layer.

19. The assembly of claim 17, wherein said one wall further comprises a cover layer on said additional layer.

20. The assembly of claim 1, wherein said rubber layer is adhesively bonded to said one steel layer.

21. The assembly of claim 20, wherein said one rubber layer is bonded to said steel layer by a two-component adhesive containing a noise attenuating material.

22. A shooting range assembly, comprising a transportable container having a pair of side walls, a front wall, a rear wall, a bottom wall and a top wall, said walls cooperating to define a shooting range internally of said container and including a door for gaining access to said shooting range, each of said walls being designed to resist penetration by projectiles and to inhibit rebounding of projectiles therefrom, and at least one of said walls comprising a steel layer, a rubber layer bonded to said steel layer, and a noise attenuating layer, said noise attenuating layer including a plurality of plates each of which is inclined with respect to said steel and rubber layers; target means carried by said container; and ventilating means for ventilating said shooting range mounted on said container.

23. A shooting range assembly, comprising a transportable container having a pair of side walls, a front wall, a rear wall, a bottom wall and a top wall, said walls cooperating to define a shooting range internally of said container and including a door for gaining access to said shooting range, each of said walls being designed to resist penetration by projectiles and to inhibit rebounding of projectiles therefrom, and at least one of said walls comprising a steel layer, a rubber layer bonded to said steel layer, a noise attenuating layer including a foamed material, an additional layer of foamed material on said noise attenuating layer, and a cover layer comprising a polyurethane film on said additional layer; target means carried by said container; and ventilating means for ventilating said shooting range mounted on said container.

* * * * *